US005707954A

United States Patent [19]

Lee

[11] Patent Number: 5,707,954

[45] Date of Patent: Jan. 13, 1998

[54] STABILIZED BROMINATED ALKANE SOLVENT

[75] Inventor: Burnell Lee, Baton Rouge, La.

[73] Assignee: Albemarle Corporation, Richmond, Va.

[21] Appl. No.: 609,590

[22] Filed: Mar. 1, 1996

[51] Int. Cl.[6] ..... C11D 7/30; C11D 3/24

[52] U.S. Cl. ..... 510/412; 134/40; 252/364; 510/255; 510/256; 510/273; 510/365; 570/102

[58] Field of Search ..... 510/412, 255, 510/256, 273, 258, 365; 252/364; 134/40; 570/102

[56] References Cited

U.S. PATENT DOCUMENTS

| | | | |
|---|---|---|---|
| 2,371,645 | 3/1945 | Aitchison et al. | 134/31 |
| 3,730,904 | 5/1973 | Clementson et al. | 252/171 |
| 3,773,677 | 11/1973 | Boyles | 252/172 |
| 4,056,403 | 11/1977 | Cramer et al. | 134/22 R |
| 4,107,077 | 8/1978 | Sullivan, Jr. et al. | 252/408 |
| 4,351,973 | 9/1982 | Ishibe et al. | 570/104 |
| 4,652,389 | 3/1987 | Moll | 252/90 |
| 4,900,456 | 2/1990 | Ogilvy | 252/8.551 |
| 5,102,573 | 4/1992 | Han et al. | 252/153 |
| 5,190,678 | 3/1993 | Swartz et al. | 252/18 |
| 5,207,953 | 5/1993 | Thorssen et al. | 252/601 |
| 5,320,683 | 6/1994 | Samejima et al. | 134/40 |
| 5,403,507 | 4/1995 | Henry | 252/170 |
| 5,492,645 | 2/1996 | Oshima et al. | 252/171 |
| 5,616,549 | 4/1997 | Clark | 510/412 |

FOREIGN PATENT DOCUMENTS

| | | |
|---|---|---|
| 0609004 | 8/1994 | European Pat. Off. . |
| 6128591 | 5/1994 | Japan . |
| 7150197 | 6/1995 | Japan . |

OTHER PUBLICATIONS

Kirk–Othmer *Encyclopedia Of Chemical Technology*, "Blood, Coagulants and Anticoagulants to Cardiovascular Agents", Third Edition, vol. 4, (1978), John Wiley & Sons, Inc., New York, pp. 256, 257, 262.

NFPA 325—National Fire Protection Association, Inc., *Guide to Fire Hazard Properties of Flammable Liquids, Gases, and Volatile Solids*, 1994 Edition, prepared by the Technical Committee on Classification and Properties of Hazardous Chemical Data, pp. 325–1–325–94 no month available.

Abstract—Japanese Patent No. 03173835–A published Jul. 29, 1991, assigned to Asahi Glass, entitled "New stabilising (pseudo) azeotropic tri: cloro: di: fluoroethane composition useful as substitute freon and for heat transfer medium, foaming agent and precision instrument parts".

*Primary Examiner*—Christine Skane
*Attorney, Agent, or Firm*—E. E. Spielman, Jr.

[57] ABSTRACT

A stabilized solvent composition which is comprised of: a solvent portion which includes at least 90 wt % n-propyl bromide; and a 1,4-dioxane-free stabilizer system which includes 2,2-dialkoxypropane in which each alkoxy group independently contains up to 3 carbon atoms. The solvent composition is useful as a degreaser and cleaner in both cold and vapor cleaning systems.

6 Claims, No Drawings

STABILIZED BROMINATED ALKANE SOLVENT

BACKGROUND OF THE INVENTION

This invention relates to a novel, high performance solvent composition based upon a brominated alkane solvent and a 1,4-dioxane-free stabilizer system.

The degreasing and cleaning industries are presently facing a ban on the use of 1,1,1-trichloroethane (TCE) as a deterging solvent. The ban is based upon TCE's relatively high ODP (Ozone Depletion Potential). Several alternatives have been suggested, but most have been rejected due to the lack of high solvent function, cost, toxicity, flammability, etc. One alternative, n-propyl bromide, looks to be ideal. It has a low and acceptable ODP. It has been shown that its solvent function is similar to that of TCE and that it can be made relatively pure, say 99+wt %, at an acceptable cost. Further, n-propyl bromide shows promise in toxicity tests. There is some confusion in the art as to its flammability, but recent testing has shown that it can be considered non-flammable.

Experimental work shows that n-propyl bromide can be used in both cold and vapor cleaning systems. Surprisingly, it has been learned that n-propyl bromide is fairly stable when used at low temperatures, say temperatures up to about 55° C. Tests have shown that in cold cleaning systems, n-propyl bromide needs little, if any, stabilization. However, if n-propyl bromide is used in vapor cleaning systems, then stabilization is necessary. The higher temperatures, say about 69°–71° C., can lead to the corrosion of metals such as steel, titanium, aluminum and magnesium. It is believed that the metal catalyzes the dehydrobromination of n-propyl bromide to yield HBr which in turn is available to corrode the metal.

The prior art is replete with stabilizers to attenuate the catalytic activity of the metal and/or to deactivate any hydrogen halide produced. The art is most instructive in the area that was of high interest, i.e., the area concerning chlorohydrocarbon solvents. Much less art is available in the area of bromohydrocarbon solvents. Due to the newly discovered attractiveness of brominated solvents, the art is just now vigorously investigating the selection of the best combination of brominated solvent and stabilizing system. The combination possibilities are innumerable, but the advantage will go to the discoverer of that ideal match between a particular brominated solvent and a particular stabilizing system. Not all of the old prior art solvent system components are now considered to be acceptable candidates due to present day concerns about health and the environment. For example, a very common and efficacious stabilizing component, 1,4-dioxane, is not now favored due to health concerns. This is unfortunate, because 1,4-dioxane is an especially good stabilizer component for attenuating an increase in the acidity of a solvent system under strong oxidizing conditions.

It is, therefore, an object of this invention to provide a degreasing and cleaning solvent which is highly efficacious and which is friendly to both the user and the environment.

THE INVENTION

This invention relates to a stabilized degreasing and cleaning solvent composition which is comprised of: a solvent portion which includes at least 90 wt % n-propyl bromide; and a 1,4-dioxane-free stabilizer system which comprises 2,2-dialkoxypropane. In addition, the stabilizer system may contain nitroalkane, nitrobenzene, an epoxide, such as 1,2-butylene oxide and/or an amine. Except as indicated to be otherwise, the wt % and ppm values used herein are based upon the total weight of the solvent composition.

Preferably, the n-propyl bromide is supplied to the composition as 99+wt % n-propyl bromide, with the most common impurity being iso-propyl bromide. The weight percentage and ppm recited in this paragraph are based on the total weight of n-propyl bromide and impurities. Commercially suitable n-propyl bromide may be accompanied by as much as 6 wt % iso-propyl bromide. n-Propyl bromide of much less purity is permissible, but not desired. The iso-propyl bromide impurity is naturally found in the raw n-propyl bromide product, but its presence can be attenuated by distillation. It is not a benign impurity as it is very much less stable than n-propyl bromide and, thus, can result in aggressive corrosion. A typical raw n-propyl bromide product will contain 96 wt % n-propyl bromide and about 4 wt % iso-propyl bromide. For vapor degreasing and cleaning, the preferred iso-propyl bromide content will be kept low, say within the range of from about 250 to about 1000 ppm. n-Propyl bromide can be purchased commercially from Albemarle Corporation, Richmond Va.

The solvent composition is, as before noted, 1,4-dioxane-free-that is, it comprises no more than an impurity amount of the solvent composition, say less than about 500 ppm. It is preferred that no 1,4-dioxane whatsoever be present in the solvent composition.

The 2,2-dialkoxypropane component of the stabilizer system is characterized in that the alkoxy groups can each independently contain one to three carbon atoms. For example, each alkoxy group can be selected from methoxy, ethoxy and propoxy. The most preferred 2,2-dialkoxypropane is 2,2-dimethoxypropane, which is a known compound and has been given CAS #77-76-9. The dialkoxypropanes of this invention have been discovered to have an unusual ability for attenuating the acid content of n-propyl bromide based solvent compositions which are under oxidation stress. Other stabilizer compounds, such as 1,3-dioxolane, acetal, diethoxymethane and acetaldehyde dimethyl acetal, are not nearly as effective.

The 2,2-dialkoxypropane is generally used in an amount within the range of from about 2.0 to about 6.0 wt %, based upon the total weight of the solvent composition. Preferred is 2.0 to 4.0 wt %.

As before noted, the stabilizer system of this invention can additionally contain conventional stabilizers, e.g., nitroalkane, nitrobenzene, epoxide and/or amine. These additional stabilizers act to further enhance the stability of the solvent system so that the dehydrobromination catalyzed by the metal is discouraged and/or so that HBr which is produced is neutralized.

The nitroalkanes usable in the present invention include nitromethane, nitroethane, 1-nitropropane, and 2-nitropropane and nitrobenzene. They are usable either singly or in the form of a mixture of two or more of them. The nitroalkane is preferably nitromethane, nitroethane or mixtures thereof. The most preferred is nitromethane. The amount of nitroalkane used will generally be within the range of from about 0.045 to about 1.0 wt %. A preferred amount will be within the range of from about 0.3 to about 0.6 wt %.

The epoxides include epichlorohydrin, propylene oxide, butylene oxide, cyclohexene oxide, glycidyl methyl ether, glycidyl methacrylate, pentene oxide, cyclopentene oxide and cyclohexene oxide. Preferred is 1,2-epoxybutane. They are usable either singularly or in the form of a mixture of two or more of them. The amount of epoxide used will generally be within the range of from about 0.045 to about 1.0 wt %. A preferred amount will be within the range of from about 0.3 to about 0.6 wt %.

The amines include hexylamine, octylamine, 2-ethylhexylamine, dodecyl-amine, ethylbutylamine, hexylmethylamine, butyloctylamine, dibutylamine, octadecyl-methylamine, triethylamine, tributylamine, diethyloctylamine, tetradecyldimethylamine, diisobutylamine, diisopropylamine, pentylamine, N-methylmorpholine, iso-propylamine, cyclohexylamine, butylamine, isobutylamine, dipropylamine, 2,2,2,6-tetramethylpiperidine, N,N-di-allyl-p-phenylenediamine, diallyamine, aniline, ethylenediamine, propylenediamine, diethylene-triamine, tetraethylenepentamine, benzylamine, dibenzylamine, diphenylamine and diethyl-hydroxyamine. They are usable either singularly or in the form of a mixture of two or more of them. The amount of amine used will generally be within the range of from about 0.25 to about 1.0 wt %. A preferred amount will be within the range of from about 0.3 to about 1.0 wt. %.

It is within the scope of this invention for the solvent compositions of this invention to be used in the presence of and in conjunction with other solvents or solvent systems and additives. For example, the solvent compositions of this invention can be mixed with a solvent such as hexane, n-butyl bromide, etc. An exemplary additive is an anti-rust additive. The solvent composition of this invention may comprise from less than 50 to more than 90 wt % of the total weight of the solvent composition of this invention and the other solvent or solvent system or additive.

Quantitatively, the solvent compositions of this invention, as before noted, will contain at least about 90 wt % n-propyl bromide, with the balance being impurities, e.g., iso-propyl bromide, the stabilizer system of this invention and any other additives desired by the practitioner. A typical solvent composition in which the n-propyl bromide used is not particularly pure, will contain about 90–92 wt % n-propyl bromide, about 4–6 wt % iso-propyl bromide, about 0.25–1.0 wt % nitromethane, 0.25–1.0 wt % 1,2-butylene oxide and about 2.0–6.0 wt % 2,2- dialkoxypropane, e.g., 2,2-dimethoxypropane. If the n-propyl oxide is of high purity, then the n-propyl bromide could be about 94–98 wt % of the solvent composition, all based on the total weight of the solvent composition.

The solvent compositions of this invention are suitable for use in cold cleaning applications and in vapor cleaning operations. The former are generally characterized by immersion of the article to be cleaned in the solvent composition at a temperature which is usually within the range of from about room temperature to about 55° C. Vapor cleaning is characterized by passing the article to be cleaned through a vapor of the solvent composition, with the article at a temperature which causes condensation of the vapor on its surfaces. The condensate effects its cleaning function and then drips off. The vapor temperatures are generally approximate to the boiling point of the solvent composition, which, in the instant case, will be around 65°to 75° C. depending upon the particular quantitative and qualitative identity of the solvent composition being used. For a solvent composition where the n-propyl bromide content is very high, say above 95 wt %, the boiling point will be around 69°–72° C.

The following illustrates the efficacious nature of solvent compositions of this invention. It is not intended for the Example to be taken, in any way, as limiting the scope of the inventions described herein.

EXAMPLE

A solvent composition was prepared by mixing the following ingredients together:

96.5 wt % n-propyl bromide
2.5 wt % 2,2-dimethoxypropane
0.5 wt % 1,2-butylene oxide
0.5 wt % nitromethane The acidity of the composition was determined. Subsequently, the composition was exposed to oxidation stress in the presence of steel strips as described in Military Specification MIL-T-81533 A Notice I, 29 Oct., 1991, "Tri chloroethane 1,1,1, (Methyl Chloroform) Inhibited, Vapor Degreasing". See in particular, Paragraph 4.4.7.2, entitled "Acidity after accelerated oxidation".

The determination of the acidity was done in accordance with Paragraph 4.4.71 of the same Specification.

In accordance with the directions in Paragraph 4.4.7.2, an apparatus was set up as shown in FIG. 1 of the Specification. A strip of steel, ½ inch by 2 inches by 1/16 inch, was suspended by means of an uncoated cooper wire so as to remain above the liquid level in the flask. Another steel strip, ¼ inch by ¾ inch by 1/16 inch, was placed in the bottom of the flask. The strips conformed to SAE steel within the range of 1010 and 1040. The condenser water was turned on. The oxygen flow was started and regulated to 10–12 bubbles per minute. The solution was then heated to reflux for a period of 48 hours. After the 48-hour period, the solvent was cooled to ambient temperature. A 25 ml sample was taken and its acidity determined, again, in accordance with Paragraph 4.4.7.1.

This same procedure was repeated with different compositions-the only difference being the presence of a different stabilizer which was used in the stead of 2,2-dimethoxy-propane. This other stabilizer is identified in the Table below. The n-propyl bromide and the nitromethane and 1,2-butylene oxide co-stabilizers were used in the same amounts in all cases

TABLE

| STABILIZER | BEFORE/AFTER TEST | ACIDITY PPM AS HCL |
|---|---|---|
| 1,4-dioxane | before | 2.0 |
| 1,4-dioxane | after | 21.8 |
| 1,3-dioxolane | before | 29.0 |
| 1,3-dioxolane | after | 65.7 |
| diethoxymethane | before | 33.1 |
| diethoxymethane | after | 124.0 |
| 2,2-dimethoxypropane | before | 30.7 |
| 2,2-dimethoxypropane | after | 46.3 |
| acetaldehyde dimethyl acetal | before | 34.9 |
| acetaldehyde dimethyl acetal | after | 92.5 |
| acetaldehyde dimethyl acetal | before | 39.3 |
| acetaldehyde dimethyl acetal | after | 96.9 |

I claim:

1. A stabilized solvent composition which is comprised of a solvent portion which includes at least 90 wt % n-propyl bromide and a 1,4-dioxane-free stabilizer system which consists essentially of 2.0–6.0 wt % 2,2-dialkoxypropane and at least one selected from the group consisting of about 0.045–1.0 wt % nitroalkane, about 0.045–1.0 wt % epoxide and about 0.045–1.0 wt % amine.

2. The solvent composition of claim 1 wherein the n-propyl bromide is present in the solvent composition in an amount within the range of from about 94 to about 98 wt %.

3. The solvent composition of claim 1 wherein the 2,2-alkoxypropane is 2,2-dimethoxy-propane.

4. The solvent composition of claim 1 whereto the nitroalkane is nitromethane and the epoxide is 1,2-butylene oxide.

5. A process for cleaning an article which comprises immersing the article in a solvent composition comprised of a solvent portion which includes at least 90 wt % n-propyl bromide and a 1,4-dioxane-free stabilizer system which consists essentially of 2.0–6.0 wt % 2,2-dialkoxypropane and at least one selected from the group consisting of about 0.045–1.0 wt % nitroalkane, about 0.045–1.0 wt % epoxide and about 0.045–1.0 wt % amine.

6. A process for cleaning an article which comprises exposing the article to the vapor emanating from a boiling body of a solvent composition comprised of a solvent portion which includes at least 90 wt % n-propyl bromide and a 1,4-dioxane-free stabilizer system which consists essentially of 2.0–6.0 wt % 2,2-dialkoxypropane and at least one selected from the group consisting of about 0.045–1.0 wt % nitroalkane, about 0.045–1.0 wt % epoxide and about 0.045–1.0 wt % amine.

* * * * *